United States Patent [19]

Hayward

[11] 3,997,984

[45] Dec. 21, 1976

[54] ORTHOPEDIC CANVAS SHOE

[76] Inventor: George J. Hayward, 6285 Granada Drive, Salt Lake City, Utah 84121

[22] Filed: Nov. 19, 1975

[21] Appl. No.: 633,275

[52] U.S. Cl. ..... 36/91; 128/621

[51] Int. Cl.[2] ..... A43B 7/22; A61F 5/14

[58] Field of Search ..... 36/28, 71, 91, 92, 69, 36/8.2, 9 R, 43, 25 R, 30 R; 128/586, 607, 621

[56] References Cited

UNITED STATES PATENTS

| | | | |
|---|---|---|---|
| 3,067,532 | 12/1962 | Peterson | 36/9 R |
| 3,121,431 | 2/1964 | Rosenhaft | 128/607 |
| 3,500,561 | 3/1970 | Epstein | 36/92 |
| 3,566,486 | 3/1971 | Conway | 36/71 |

*Primary Examiner*—Patrick D. Lawson
*Attorney, Agent, or Firm*—Criddle, Thorpe & Western

[57] ABSTRACT

An orthopedic canvas shoe containing a supporting arch and having a continuous flexible sole wherein the sole is formed such that the inside heel and arch portions of the sole are slightly elevated with respect to the remainder of the sole. The arch of the shoe is positioned such that the highest portion of the arch fits directly beneath the navicular bone of the foot. The arch is further supported and the foot held in proper position by extending the sole forwardly from the heel to the widest portion of the shoe supporting the ball of the foot in a straight line.

6 Claims, 5 Drawing Figures

ORTHOPEDIC CANVAS SHOE

BACKGROUND OF THE INVENTION

This invention relates to an orthopedic canvas shoe having a continuous flexible sole. More particularly, this invention relates to an orthopedic canvas shoe having a flexible sole wherein the shoe enables the wearer to maintain a proper foot position.

Flexible soled canvas shoes are well known in the art and are often referred to under various names such as tennis shoes, deck shoes, gym shoes, sneakers and the like. Such shoes are usually designed for either athletic or casual wear, but are becoming increasingly popular as the principal shoe for children in school and every day wear.

Such shoes are often not rigidly constructed and offer little or no assistance in insuring proper positioning of the feet. As a result of improper support in the arch and heel areas, there is a tendency for the arch to collapse and for the foot to be forced inwardly thereby resulting in the knees becoming closer together and the metatarsal and phalanges area of the foot to extend outwardly. Such a condition is referred to as a "pronated foot." A person with a pronated foot is often referred to as having flat feet because of the collapse of the muscles in the area of the arch.

In a normal foot position there is an essentially straight line relationship extending from the innerside of the heel past the navicular bone to the point of juncture of the big toe with its corresponding metatarsal. This area is commonly referred to as the ball of the foot. Similarly, there is a straight line relationship running from the center of the heel longitudinally, along the foot through the second toe of the foot. This line runs essentially parallel to the first line mentioned above. On the other hand, in a pronated foot a line drawn from the calcaneus or heel bone to the navicular bone and a line drawn from the navicular bone to the ball of the foot will form intersecting lines rather than being a straight line. Also, there is no straight line relationship from the heel to the second toe of the foot. In such a pronated foot the plantar arch has collapsed and the ligaments in the foot have given way failing to lend the proper support to the arches.

Because of the lack of rigidity, improper placement of the arch support and general construction of flexible soled canvas top shoes, there is often a tendency for pronation of the feet to occur and be accentuated. As a result, the arch area on the inside of the shoe is often overrun by the foot and the toe of the shoe will extend outwardly.

OBJECTS OF THE INVENTION

It is an object of the present invention to provide a flexible soled canvas shoe which will correct or inhibit pronation of the feet.

It is also an object of the present invention to provide a flexible soled canvas shoe wherein proper support is placed in the area of the arch of the foot and whereby overrunning in the arch area is inhibited.

It is still another object of this invention to provide a flexible soled canvas shoe wherein the medial side of the heel portion of the shoe is elevated with respect to the lateral side.

These and other objects may be accomplished by means of a flexible soled canvas shoe, the principal features of which include the proper placement of an arch in the inside of the shoe and a medial wedge in the flexible sole of the shoe.

Flexible soled shoes currently marketed contain an arcuate sole pattern on the medial side of the sole extending from the beginning of the metatarsal area of the foot underlying the plantar arch and curving outwardly in the area of the heel. In the present invention, the sole is so constructed that there is no such arcuate area. The sole follows a solid essentially straight line from the heel to the point of juncture of metatarsals with the phalanges, i.e., the ball of the foot. Moreover, the sole contains a contiguous medial wedge in the heel thereby making the heel portion of the sole in the medial area of greater depth than at the lateral area. Said slope gradually decreases transversely across the sole to the lateral side and longitudinally to the forward portion of the sole terminating just forward of the navicular bone. Additionally, the arch support contained under the innersole of the shoe is positioned such that the highest portion of the arch is immediately beneath the navicular bone in the tarsal area of the foot. Said arch gradually slopes downwardly in both longitudinal and lateral directions.

DRAWINGS OF THE INVENTION

DETAILED DESCRIPTION OF THE INVENTION

Figure 1:
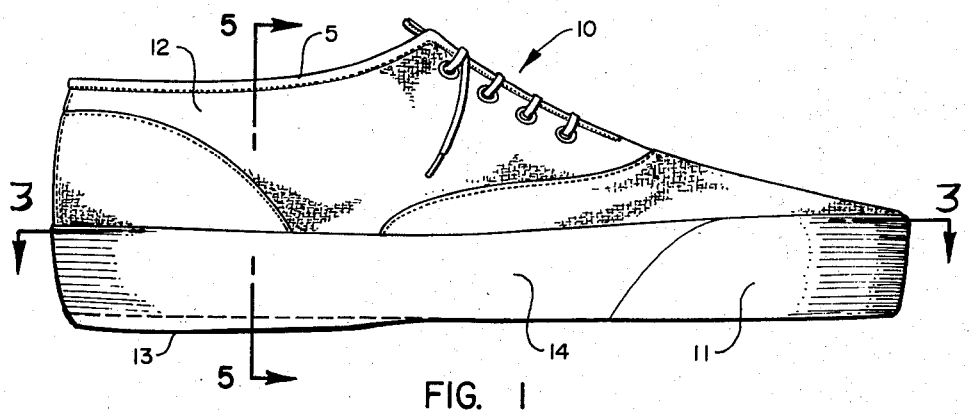
FIG. 1 is a side elevational view showing the medial or inside of the flexible soled canvas shoe claimed in this invention.
Figure 2:
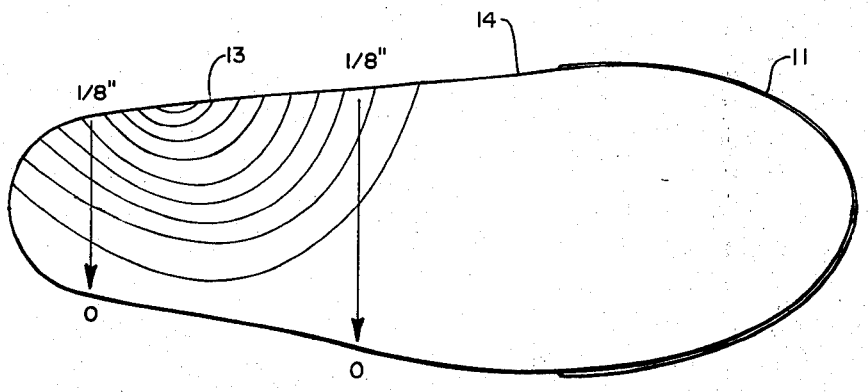
FIG. 2 is a bottom view showing the flexible sole and the medial wedge portion contained thereon.
Figure 3:
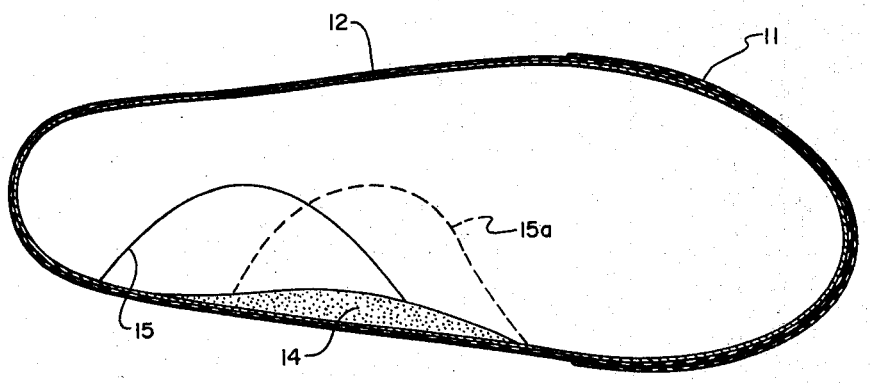
FIG. 3 is a top sectional view of the orthopedic shoe illustrated in FIG. 1 taken along lines 3—3 of FIG. 1.
Figure 4:
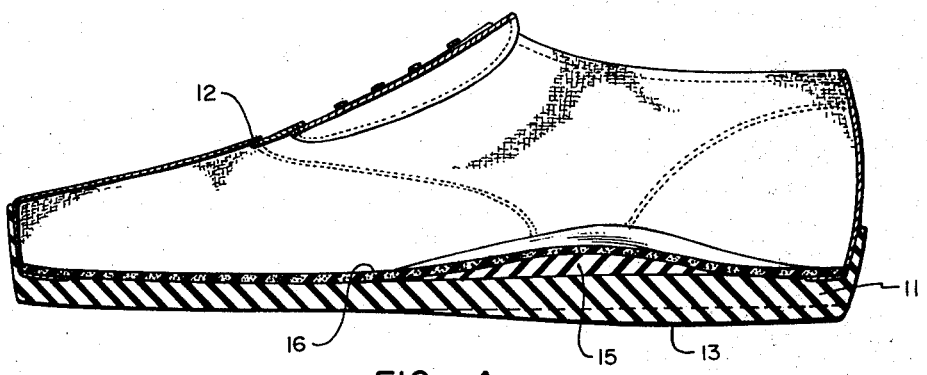
FIG. 4 is a side longitudinal sectional view of the orthopedic shoe taken along lines 4—4 of FIG. 2.
Figure 5:
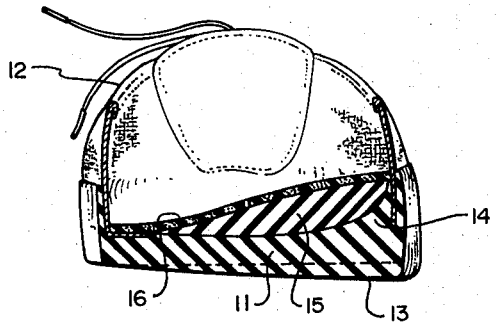
FIG. 5 is a transverse cross sectional view of the orthopedic shoe taken along lines 5—5 of FIG. 1.

Referring now to the drawings:

There is shown in FIGS. 1 through 5 an operative embodiment of the present invention. The invention comprises an orthopedic shoe 10 comprising a flexible sole 11 and a canvas top 12. The flexible sole 11 may be made of any suitable material of rubberlike consistency including natural and synthetic rubbers plasticized polymers, copolymers, and block copolymers. Such materials are well known and are traditionally used in making flexible soled canvas shoes. The sole is shaped such that the medial or inside of the heel portion of the shoe contains a heel wedge 13 which gradually slopes toward the flat level of the sole on the lateral side and longitudinally just forward of the navicular bone. The heel wedge is a continuous part of the sole. As best illustrated in FIGS. 3 and 5, the sole curves upwardly on the medial side in the area of the plantar arch and thus forms a straight area 14 extending from the calcaneus bone to the widest point of the shoe, which area is commonly called the ball of the foot. Thus, the traditional arch portion of the canvas shoe is filled in and becomes an integral part of the sole thereby providing additional support for the arch and preventing running over on the medial side of the shoe.

An additional feature of the shoe which is unique is the placement of the arch support 15. The conventional placement of the arch is illustrated in FIG. 3 by dotted line 15*a*. However, it has been discovered that if the arch support is so placed that the highest portion of the arch support 15 is positioned to be under the highest portion of the arch, that pronation of the feet may be inhibited and better foot position be obtained. Thus, the arch, as illustrated in FIG. 3, is moved backwardly such that the highest point of the arch support will be directly beneath the navicular bone in the tarsal area of the foot. Due to the arch support being moved backward to be under the navicular bone instead of being in the conventional position, the arch support 15 is higher by about ⅛ to ¼ of an inch than conventional arch supports with 3/16 of an inch being preferable. If desired, the arch support may be molded into the sole as an integral part thereof or may be otherwise glued and fastened between sole 11 and insole portion 16. With the combination of the arch 15, the filled in sole portion 14 and the heel wedge 13, the foot is forced into a forward or normal position rather than being in a pronated position. By utilizing the shoe of the present invention, the wearer does not have a tendency to have the ankle turn inwardly overriding the arch support and turning the forward portion of the shoe outwardly in relation to the heel portion. By utilizing such a shoe, correct foot position is not only maintained, but the feet are more rested and the wearer does not tire as easily.

While the invention is preferably designed for children and young adults with growing feet, it may also be utilized advantageously by adults and plantar arches, as well as preventing pronation of the feet.

It will be obvious that the shoes can be mass produced according to conventional shoe making techniques. For example, the medial wedge in the heel can be achieved by rotating the last in the process of manufacturing. On the other hand, it is also obvious that the shoe can be manufactured having the arch portion 14 filled in but having the heel wedge 13 and arch support 15 attached to the shoe according to a doctor's prescription as to the dimensions of such arch support and/or wedge.

Although the invention, as has been described, is deemed to be that which would form the preferred embodiment, it is recognized that departures may be made therefrom without departing from the scope of the invention which is not to be limited to the details disclosed, but is to be accorded the full scope of the claims so as to include any and all equivalent shoes.

What is claimed is:

1. An orthopedic flexible soled canvas shoe comprising:

a. a canvas upper portion, b. a flexible sole fixedly attached to said canvas portion, and sole having a medial wedge forming part of the lower surface in the heel portion thereof which gradually slopes laterally and forwardly to become integral with the normal sole surface, said sole curving upwardly in the area of the plantar arch, terminating such that the medial side of the sole forms essentially a straight line extending from the heel of the shoe to the portion of the shoe adapted to accommodate the medial side of the ball of the foot, and c. an arch support positioned such that the highest portion of the support is located beneath the navicular bone of the foot, said support extending along the plantar arch and gradually descending in height both laterally and longitudinally from said highest point.

2. An orthopedic shoe according to claim 1 wherein the medial wedge is contiguous with the sole and is highest under the heel on the medial side and terminates just forward of the navicular bone.

3. An orthopedic shoe according to claim 2 wherein the medial wedge is about ⅛ of an inch thick on the medial side of the heel and gradually lessens in width, both laterally and forwardly in the plantar arch area of the sole.

4. An orthopedic shoe according to claim 2 wherein the arch support is positioned between the sole and the innersole of the shoe.

5. An orthopedic shoe according to claim 2, wherein the arch support is an integral part of the sole.

6. An orthopedic shoe according to claim 2 wherein the area beneath the plantar arch is solidly supported by the arch support and the upwardly curving medial side of the sole.

* * * * *